US006655329B2

(12) United States Patent
Kammerdiener et al.

(10) Patent No.: US 6,655,329 B2
(45) Date of Patent: Dec. 2, 2003

(54) VARIABLE VALVE TRAIN FOR A CAM ACTIVATED LIFTING VALVE OF AN INTERNAL COMBUSTION ENGINE

(75) Inventors: Thomas Kammerdiener, Graz (AT); Peter Herzog, Graz (AT); Peter Christian Meurer, Graz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 09/988,379

(22) Filed: Nov. 19, 2001

(65) Prior Publication Data

US 2002/0066428 A1 Jun. 6, 2002

(30) Foreign Application Priority Data

Nov. 20, 2000 (AT) ..... 858/2000 U

(51) Int. Cl.[7] ..... F01L 1/34

(52) U.S. Cl. ..... 123/90.16; 123/90.12; 123/90.13; 123/90.48; 123/90.55; 251/129.03

(58) Field of Search ..... 123/90.12, 90.13, 123/90.16, 90.48, 90.55, 90.18; 251/12, 14, 129.03

(56) References Cited

U.S. PATENT DOCUMENTS

| | | | | | |
|---|---|---|---|---|---|
| 4,671,221 | A | * | 6/1987 | Geringer et al. | 123/90.16 |
| 5,005,540 | A | | 4/1991 | Watanabe | 123/90.12 |
| 5,070,827 | A | | 12/1991 | Krieg et al. | 123/90.48 |
| 5,113,811 | A | * | 5/1992 | Rembold et al. | 123/90.12 |
| 5,127,375 | A | | 7/1992 | Bowman et al. | 123/90.12 |
| 5,154,143 | A | * | 10/1992 | Stutzenberger | 123/90.12 |
| 5,251,586 | A | * | 10/1993 | Koga et al. | 123/90.16 |
| 5,398,502 | A | * | 3/1995 | Watanabe | 60/284 |
| 5,839,453 | A | * | 11/1998 | Hu | 123/322 |
| 6,032,631 | A | | 3/2000 | Haas et al. | 123/90.15 |

FOREIGN PATENT DOCUMENTS

| | | | | |
|---|---|---|---|---|
| DE | 43 17 607 | | 12/1993 | |
| DE | 42 39 040 | | 5/1994 | |
| JP | 52006813 A | * | 1/1977 | F01L/01/14 |
| JP | 03151508 A | * | 6/1991 | F01L/13/00 |
| JP | 10252428 A | * | 9/1998 | F01L/13/00 |

* cited by examiner

*Primary Examiner*—Thomas Denion
*Assistant Examiner*—Ching Chang
(74) *Attorney, Agent, or Firm*—Dykema Gossett LLC

(57) ABSTRACT

The invention relates to a variable valve train (1) for a cam-actuated lifting valve (13) of an internal combustion engine, which valve (13) is loaded by a closing spring (13*a*) acting against the direction of opening, with an approximately cylindrical force application element (2) located between a cam (14) and the valve (13), whose length can be adjusted hydraulically and whose exterior cylindrical wall face (3) is slidable in a fixed guide cylinder (4), said element (2) being provided with a pressure piston (6) longitudinally slidable in a cylinder (5), which piston (6) is adjacent to a pressure chamber (7) into which opens a pressure channel (8) departing from a port (9) in the wall face (3) of the force application element (2), a fixed pressure line (11) opening into the guide cylinder (4) in the area of the port (9), which line (11) can be subjected to hydraulic high pressure ($p_H$) permitting hydraulic activation of the valve (13). In order to obtain a variable valve train (1) independet of crank angle (KW) in as simple a manner as possible, a permanent flow connection is provided between pressure line (11) and pressure channel (8) independently of the position of the force application element (2).

27 Claims, 2 Drawing Sheets

VARIABLE VALVE TRAIN FOR A CAM ACTIVATED LIFTING VALVE OF AN INTERNAL COMBUSTION ENGINE

BACKGROUND OF THE INVENTION

The invention relates to a variable valve train for a cam-actuated lifting valve of an internal combustion engine, which valve is loaded by a closing spring acting against the direction of opening, with a force application element located between a cam and the valve, whose length can be adjusted hydraulically and whose exterior cylindrical wall face is slidable in a fixed guide cylinder, said element being provided with a pressure piston longitudinally slidable in a cylinder, which piston is adjacent to a pressure chamber into which opens a pressure channel departing from a port in the wall face of the force application element, a fixed pressure line opening into the guide cylinder in the area of the port, which line can be subjected to hydraulic high pressure permitting hydraulic activation of the valve.

DESCRIPTION OF PRIOR ART

A variable valve train for a lifting valve is disclosed in DE 43 17 607 A1, where an additional hydraulical lift is effected in the course of the mechanical lifting phase performed by the cam. The known mechanism will permit the additional hydraulic activation only while the pressure line and the pressure channel of the force application means formed by a cup-shaped tappet are overlapping. For the time when the base circle of the cam is in contact with the tappet, fluid delivery to the tappet will be interrupted. The hydraulic activation of the valve will thus be restricted to a very limited period. As a consequence, the influence on valve lift and valve timing will be small.

In addition, several "lost motion" systems are known, in which the pressure generated in the valve train is coupled to the speed of the camshaft.

Such a valve train is described in U.S. Pat. No. 5,127,375 A, for example. The disadvantage of the system is that pressure cannot be actively applied as with an hydraulic lifting means, so that the valve cannot be opened hydraulically for a second time.

U.S. Pat. No. 5,216,988 describes a valve actuator where pressure generation and transmission take place in the tappet. A scavenging pump connected to the interior of the tappet and a discharge valve will help remove air bubbles from the system.

In U.S. Pat. No. 5,005,540 a valve timing control system is disclosed where an hydraulic valve lifter is provided between the cam and the valve. Via an external pump a preliminary oil pressure is produced in the hydraulic valve lifter. An electromagnetic relief valve is provided for draining the oil chamber of the valve lifter. Once again, no active hydraulic valve lift will be possible.

DE 42 39 040 A1 describes mechanical-hydraulical means for the transmission of motion between the camshaft and the charge exchange valves of an internal combustion engine, including an hydraulic compensation for play. This will permit the backflow of oil from a high-pressure oil chamber located in the tappet into an oil return line during mechanical actuation of the valves. An active hydraulic valve lift independent of the mechanical valve lift will not be possible.

SUMMARY OF THE INVENTION

It is the object of the present invention to avoid such disadvantages and to provide for a variety of options in the design of valve lift and valve opening for a valve train as described above.

In the invention this object is achieved by providing for a permanent flow connection between pressure line and pressure channel independent of the position of the force application element. In this way an hydraulic actuation of the valve will be possible regardless of camshaft position. Preferably, the end of the pressure line opening into the guide cylinder and the port in the wall face of the force application element should overlap in every position. To obtain continuous overlapping, a valve train where the force application element can perform a lift corresponding to the cam lift should preferably be provided between pressure line and pressure channel with a recess communicating with both pressure line and pressure channel, the height of which recess, as measured in the direction of the lift, will correspond to at least the maximum lift of the force application element. The recess may be located in the guide cylinder or in the exterior wall face of the force application element.

In this way the valve will be hydraulically activated and given an additional lift during the mechanical lifting phase performed by the cam. By the change in valve timing and valve lift curves the exhaust gas temperature may be raised purposefully in order to satisfy the demands of an exhaust treatment system with respect to an increased conversion rate. For implementation of this operating strategy the operating points of relevance for the respective emission test cycle may be used.

The variable valve train will also enable the valve to re-open hydraulically at least once after the mechanical lifting phase performed by the cam has come to an end. In this manner a combustion process with homogeneous carburetion and self-ignition of the fuel will be obtained, in the course of which the exhaust valves are opened several times during a working cycle, in order to control composition and temperature of the charge as well as ignition conditions. Repeated opening of the exhaust valve will lead to internal exhaust recirculation.

To permit an active hydraulic lifting during the mechanical lifting of the valve, it is provided by the invention that the pressure line be connected to an external pressure generating unit comprising at least one pump, at least one pressure tank with at least one pressure regulator, and at least one pressure control element. To achieve an additional lift during the phase of increasing valve lift, the required control pressure is actively supplied from the external pressure tank via control elements.

The pressure control element may be configured as a solenoid valve or piezo-valve. A pressure control valve may be assigned to each individual lifting valve, although it would be more economical to actuate several lifting valves by means of one and the same control element.

According to a preferred variant of the invention the force application element is located between the cam and the lifting valve, and preferably, it is coaxial with the valve, and more preferably it is configured as a cup-shaped tappet. Another variant provides that the force application element be located between a cam and a valve lever for actuation of the lifting valve. As an alternative, the force application element may be configured as part of a valve arm bearing block supporting a valve arm for actuation of the lifting valve. The valve arm may be configured as a rocker lever or cam follower.

The working medium and/or control medium of the pressure generating unit may be a specific hydraulic fluid or an engine operating fluid such as water, fuel, or lubricating oil. If such engine operating fluids are used it may be provided that the pressure generating unit be part of a further subsystem of the engine other than the valve train. In this instance the pressure tank of the pressure generating unit preferably is part of a fuel injection system, an automotive gear system, an hydraulic braking system, or a coolant circulation system of the vehicle.

The pressure control element of the pressure generating unit is configured as a 3/2-way valve in a preferred variant of the invention. Alternatively, two 2/2-way valves can be employed instead of the 3/2-way valve. The pressure generating unit has a high pressure level and a medium pressure level, permitting the pressure chamber of the force application element to be flow-connected to either high pressure or medium pressure level via the pressure control element. The high pressure level is preferably supplied by a first pressure tank connected to a high pressure pump. A medium pressure pump may be employed for generation of the medium pressure level.

No medium pressure pump need be provided if the medium pressure level is supplied by a medium pressure tank which is connected via a pressure reducing element to a high pressure tank for the high pressure level.

To prevent the occurrence of cavitation in the force application element in certain positions of the valve, it is provided by the invention that the force application element be connected to the medium pressure level via a pressure relief line preferably provided with a check valve opening in the direction of the force application element. In this way the pressure inside the force application element will be prevented from falling beneath a critical level enhancing the occurrence of cavitation.

In order to obtain a damping effect for the closing of the valve the pressure piston preferably is configured as a stepped piston.

In conjunction with control elements the hydraulic force application element may be employed for a switchover of individual or all cylinders to two-stroke cycle or similar operation with cylinder head scavenging. Subsequent charge exchange processes are alternatingly determined mechanically and hydraulically.

BRIEF DESCRIPTION OF THE DRAWING

The invention will now be described in closer detail with reference to the enclosed drawings, wherein.

DETAILED DESCRIPTION OF THE PREFERRED EMBODIMENTS

Figure 1:
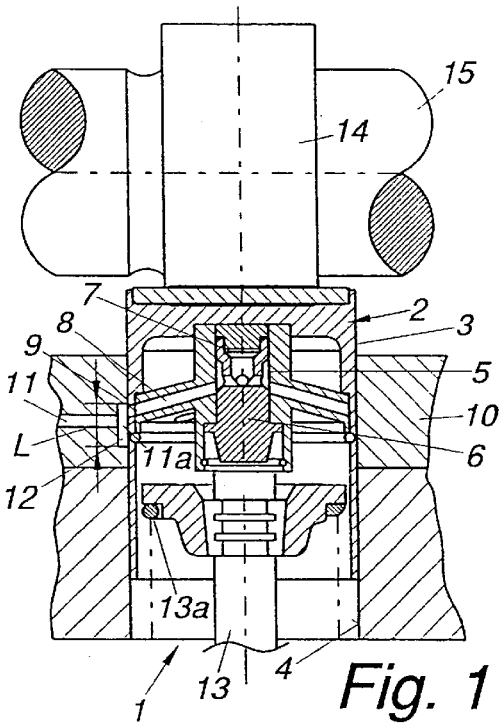
FIG. 1 shows a valve train according to the invention, in a section through the force application element in a first position.

The variable valve train 1 is provided with an essentially cylindrical pressure application element 2, whose exterior cylindrical wall face 3 slides in a fixed guide cylinder 4. Inside the force application element 2 a pressure piston 6 is held, which is longitudinally slidable in a cylinder 5 and is adjacent to a pressure chamber 7 that may be subject to hydraulic pressure. The pressure chamber 7 is in connection with at least one pressure channel 8 departing from the wall 3 of the force application element 2. The port of the pressure channel 8 in the wall 3 is referred to as 9.

In the housing 10, which may be a cylinder head or a separate valve actuation housing, a pressure line 11 is provided, which opens into the guide cylinder 4 in the area of port 9. The end of the pressure line 11 in this area is referred to as 11*a*. To permit actuation of the force application element 2 independently of the valve lift h, a hollow space is provided in the shape of a recess 12 in the area of the opening 9 between pressure line 11 and pressure channel 8, the height L of said recess 12 corresponding to at least maximum valve lift $h_{max}$ of the valve 13, which is effected by the cam 14. The opening 9 of the pressure channel 8 is disposed such that a flow connection between pressure line 11 and pressure channel 8 will be established in any position of the valve 13.

Reference numeral 13*a* refers to a spring closing the valve 13 against its opening direction.

Figure 2:
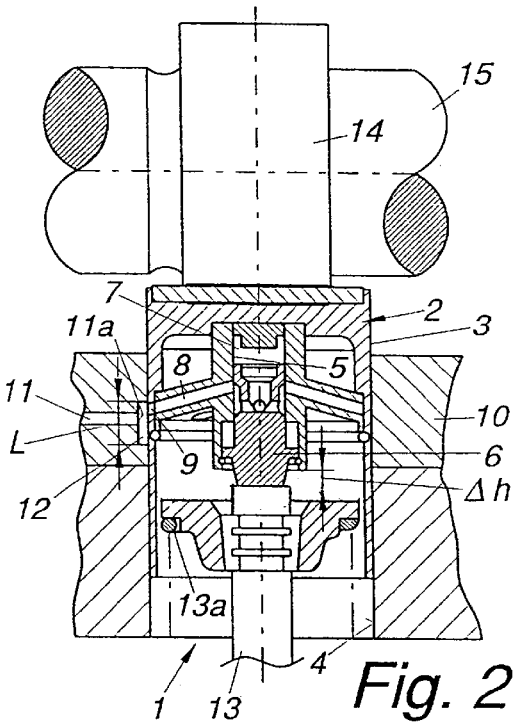
FIG. 2 shows the valve train in a second position.

In the variant shown in FIGS. 1 and 2 the force application element 2 is constituted by the tappet located between the cam 14 and the camshaft 15 and the valve 13. It would also be possible, however, to position the force application element 2 between a cam 14 and a rocker lever. Moreover, the force application element 2 could be provided as part of a valve arm bearing block for supporting a valve arm for actuation of the valve 13. In this instance the element 13 will shift the supporting point of the valve arm. The valve arm may be a rocker lever or a cam follower.

In FIG. 1 the force application element 2 is deactivated, i.e., no hydraulic lift Δh of the valve 13 is taking place. With a deactivated element 2 the lifting motion of the valve 13 is only effected mechanically by the cam 14.

Figure 5:
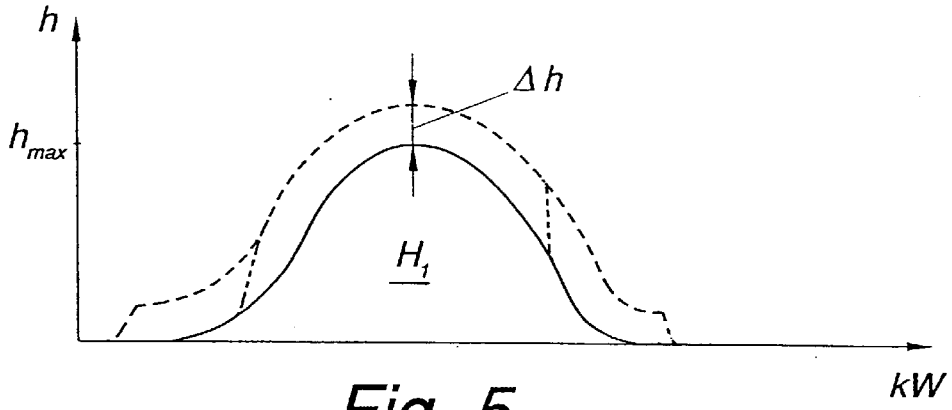
FIGS. 5 to 7 show different valve lift curves h plotted against the crank angle KW.
Figure 6:
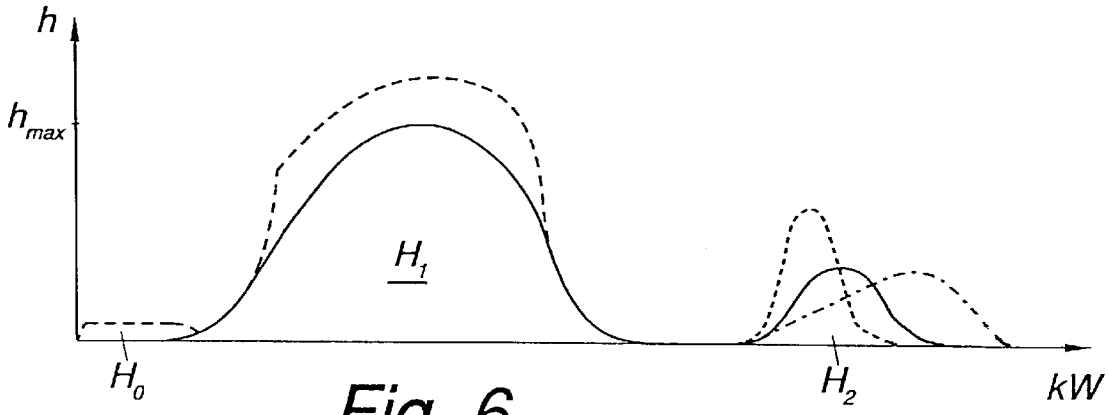
Figure 7:
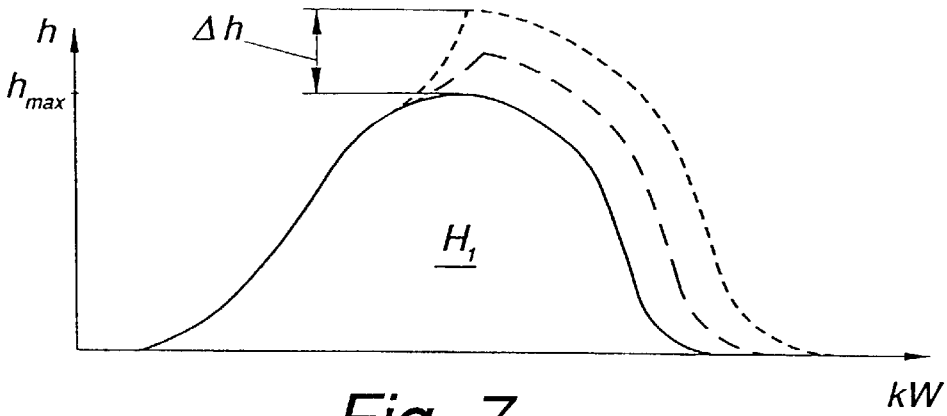

FIG. 2, on the other hand, is concerned with a force application element 2 in its activated state, i.e., the pressure chamber 7 is subject to high pressure $p_H$. In this case the pressure piston 6 is shifted in opening direction, thus pressing against the valve 13. In this way an hydraulically effected lift Δh of the valve 13 will result. The hydraulic lift Δh may take place at any time during a working cycle, as is shown in FIGS. 5 to 7. FIG. 5, for example, shows an activation of the force application element 2 in parallel with the mechanical valve lift $H_1$. The valve 13 thus performs a lift h increased by Δh. To obtain a damping effect when the valve 13 closes, the pressure piston 6 is designed as a stepped piston.

In FIG. 6 the force application element 2 effects another valve lift $H_2$ of the lifting valve 13. The shape of the lift curve of the valve during the second valve lift $H_2$ may be chosen as required, as is shown by the dashed and dash-dotted line. It would also be possible to provide for a preliminary lift $H_0$, for example to improve carburetion.

To a certain extent the force application element 2 may also be used to adjust the timing of the valve lift $H_1$ of the lifting valve 13, which is mainly effected by mechanical means. By timed activation of the force application element 2 both the valve lift h and the closing point or opening point of the lifting valve 13 may be influenced, as is shown in FIG. 7.

Figure 3:
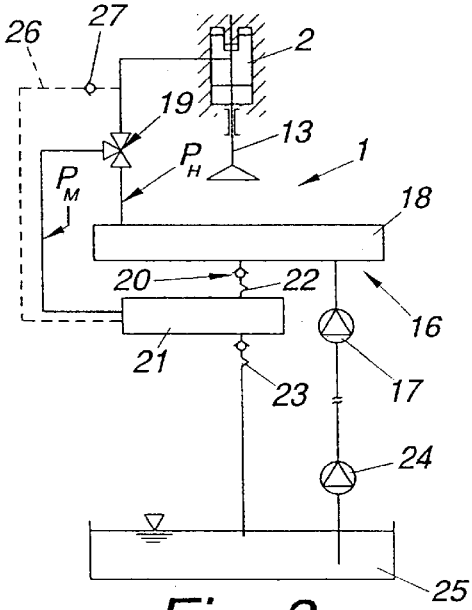
FIG. 3 shows a schematical block diagram of the valve train according to the invention, in a first variant.

To permit a variable valve actuation independent of crank angle with the use of a force application element 2 an external pressure generating unit 16 is provided, which comprises at least one high pressure pump 17, one high-pressure tank 18, one control element 19 and one pressure regulator 20. Preferably, the control element 19 is configured as a solenoid- or piezo-operated 3/2-valve providing the pressure chamber 7 either with a high pressure level $p_H$ or a medium pressure level $p_M$. In the variant shown in FIG. 3 the high pressure level $p_H$, e.g. 250 bar, is established by the high pressure tank 18 and the high pressure pump 17. The medium pressure level $p_M$ is provided by a medium pressure tank 21 connected to the high pressure tank 18 via a relief valve 22. Another relief valve 23 establishes the connection to the reservoir 25. The relief valves 22 and 23 are part of the pressure regulating means 20. Reference numeral 24 refers to a primary pump taking the operating and/or control medium out of the reservoir 25 and feeding it to the high-pressure pump 17.

To prevent the occurrence of cavitation inside the force application element 2, the pressure chamber 7 of the force application element 2 is connected to the medium pressure level $p_M$ by means of a pressure relief line 26. Inside the pressure relief line 26 is located a check valve 27 opening in the direction of the pressure chamber 7. The pressure relief line 26 will prevent the pressure in the pressure channel 8 and the pressure chamber 7 from falling below a predefined minimum value in certain operating positions of the lifting valve 13.

Figure 4:
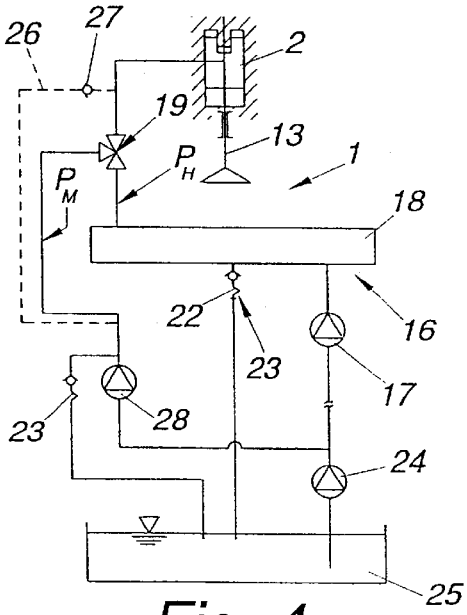
FIG. 4 shows a schematical block diagram of the valve train according to the invention, in a second variant.

In the variant shown in FIG. 4 the medium pressure value $p_M$ is generated by a separate medium pressure pump 28, which is located upstream of the primary pump 24.

The external pressure generating unit 16 may be part of a subsystem a priori provided in the vehicle for other purposes, such as the fuel injection system, or an hydraulic gear system, an hydraulic braking system, or an automotive coolant circulation system. The variable valve train 1 provides a simple means for influencing the valve lift h and the timing of lifting valves 13 independently of the position of the crankshaft.

What is claimed is:

1. A variable valve train for a cam-actuated lifting valve of an internal combustion engine, which valve is loaded by a closing spring acting against the direction of opening, with an approximately cylindrical force application element located between a cam and the valve, whose length can be adjusted hydraulically and whose exterior cylindrical wall face is slidable in a fixed guide cylinder, said element being provided with a pressure piston longitudinally slidable in a cylinder, which piston is adjacent to a pressure chamber into which opens a pressure channel departing from a port in the wall face of the force application element, a fixed pressure line opening into the guide cylinder in the area of the port, which line can be subjected to hydraulic high pressure permitting hydraulic activation of the valve, wherein a permanent flow connection is provided between pressure line and pressure channel independently of the position of the force application element.

2. A valve train according to claim 1, wherein an end of the pressure line opening into the guide cylinder and the port in the wall face of the force application element are designed to be overlapping in every position.

3. A valve train according to claim 1, wherein the force application element can perform a lift corresponding to the cam lift, wherein a recess is provided between pressure line and pressure channel which communicates with both pressure line and pressure channel, the height of which recess, as measured in the direction of the lift, will correspond to at least the maximum lift of the force application element.

4. A valve train according to claim 3, wherein the recess is configured at least partially by a space in the guide cylinder.

5. A valve train according to claim 3, wherein the recess is configured at least partially by a space in the exterior wall face of the force application element.

6. A valve train according to claim 1, wherein the force application element is located between the cam and the lifting valve.

7. A valve train according to claim 6, wherein the force application element is coaxial with the valve.

8. A valve train according to claim 6, wherein the force application element is configured as a cup-shaped tappet.

9. A valve train according to claim 1, wherein the force application element is configured as part of a valve arm bearing block supporting a valve arm for actuation of the lifting valve.

10. A valve train according to claim 1, wherein the force application element is located between the cam and a valve arm for actuation of the lifting valve.

11. A valve train according to claim 1, wherein the pressure line is connected to an external pressure generating unit comprising at least one pump, and at least one pressure tank with at least one pressure regulator, and at least one pressure control element.

12. A valve train according to claim 11, wherein the pressure control element is configured as an electromechanical element with at least one electromechanically actuated valve.

13. A valve train according to claim 11, wherein the pressure control element is configured as a piezo-mechanical element with at least one piezomechanically actuated valve.

14. A valve train according to claim 11, wherein several lifting valves can be actuated by means of one and the same pressure control element.

15. A valve train according to claim 11, wherein the pressure control element is configured as a 3/2-way valve.

16. A valve train according to claim 11, wherein the working medium or control medium of the pressure generating unit is a liquid selected from the group consisting of water, fuel, and lubricating oil.

17. A valve train according to claim 11, wherein the pressure generating unit is part of a further subsystem of the engine other than the valve train.

18. A valve train according to claim 17, wherein the pressure tank is part of a fuel injection system.

19. A valve train according to claim 17, wherein the pressure tank is part of an hydraulic gear system of the vehicle.

20. A valve train according to claim 17, wherein the pressure tank is part of a hydraulic braking system of the vehicle.

21. A valve train according to claim 17, wherein the pressure tank is part of a coolant circulation system of the vehicle.

22. A valve train according to claim 11, wherein the pressure generating unit has a high pressure level and a medium pressure level, permitting a pressure chamber of the force application element to be flow-connected to either high pressure lever or medium pressure level via the pressure control element.

23. A valve train according to claim 22, wherein the high pressure level is provided by a high pressure tank connected to a high pressure pump.

24. A valve train according to claim 22, wherein the medium pressure level is provided by a medium pressure pump.

25. A valve train according to claim 22, wherein the medium pressure level is provided by a medium pressure tank, which is connected via a relief valve to a high pressure tank for the high pressure level.

26. A valve train according to claim 11, wherein the force application element is connected to the medium pressure level via a pressure relief line provided with a check valve opening in the direction of the force application element.

27. A valve train according to claim 1, wherein the pressure piston is designed as a stepped piston.

* * * * *